United States Patent [19]

Sterken

[11] 4,045,110

[45] Aug. 30, 1977

[54] ELECTRICAL CONNECTOR HOUSINGS

[75] Inventor: Cornelus Adrianus Henricus Maria Sterken, Eindhoven, Netherlands

[73] Assignee: AMP Incorporated, Harrisburg, Pa.

[21] Appl. No.: 727,550

[22] Filed: Sept. 28, 1976

[30] Foreign Application Priority Data

Oct. 4, 1975 United Kingdom ..... 40727/75

[51] Int. Cl.[2] ..... H01R 9/16; H01R 13/54

[52] U.S. Cl. ..... 339/91 R; 339/210 R; 339/217 S

[58] Field of Search ..... 339/91 R, 92 M, 153, 339/176 M, 196 M, 200, 206 R, 210 R, 210 M, 216 R

[56] References Cited

U.S. PATENT DOCUMENTS 3,165,369 1/1965 Maston ..... 339/210 M X

*Primary Examiner*—Roy Lake
*Assistant Examiner*—E. F. Desmond
*Attorney, Agent, or Firm*—Allan B. Osborne

[57] ABSTRACT

An electrical connector housing includes two housing parts of electrically insulating material and a strip carrying a plurality of locking lances. The strip is assembled in one of the housing parts so that an individual locking lance extends into a cavity defined by aligned passageways in the two housing parts for resiliently engaging an electrical contact when received in the cavity.

4 Claims, 8 Drawing Figures

FIG.5.
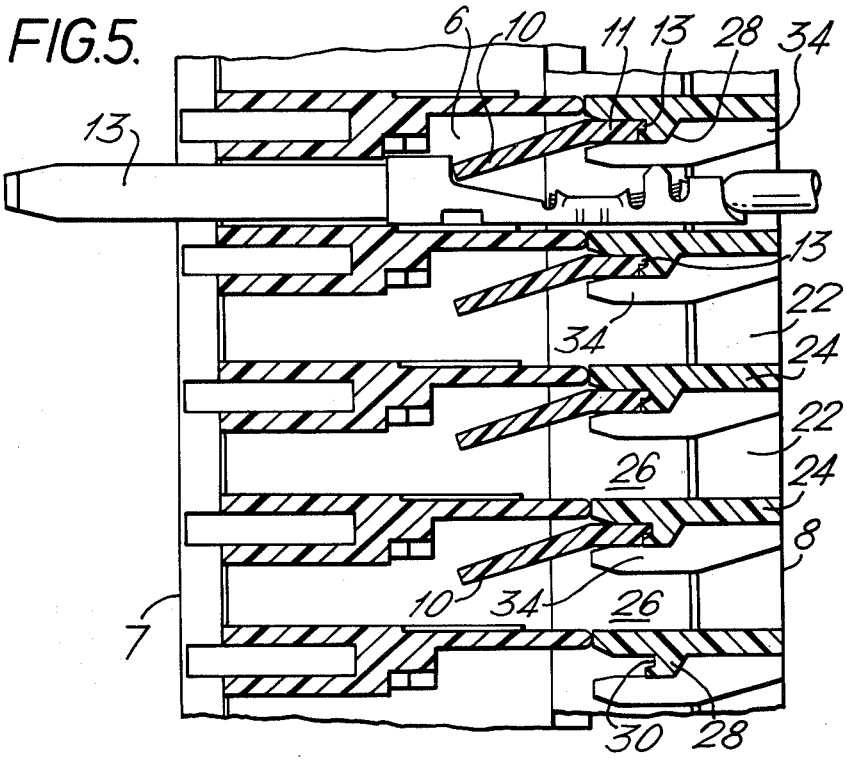
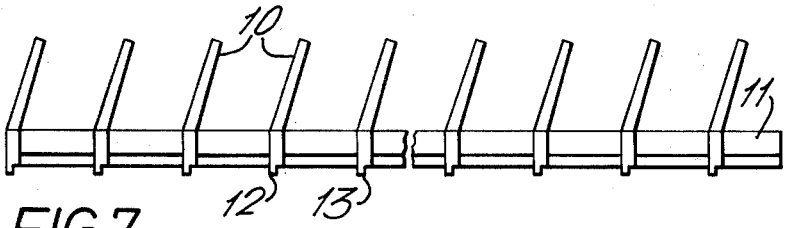
FIG.7.
FIG.8.
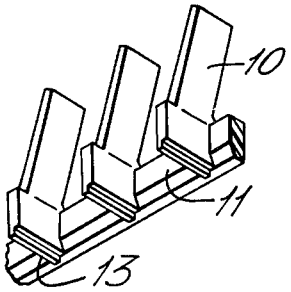

ELECTRICAL CONNECTOR HOUSINGS

BACKGROUND OF THE INVENTION

The present invention relates to electrical connector housings.

It is known, for example, from U.S. Pat. No. 3,648,213 for an electrical connector housing of electrically insulating material to have a passageway extending between opposed faces of the connector housing for receiving an electrical contact. A stiffly flexible locking lance extends into the passageway from one wall of the passageway which lance locks the electrical connector in the passageway. The lance is moulded integrally with the connector housing.

The mould tool required for producing a connector housing having a passageway extending between opposed faces and a locking lance extending from one wall of the passageway can be complicated and expensive to manufacure. This particular difficulty is accentuated where the electrical connector housing is intended to house a plurality of electrical contacts each in an individual passage-way and locked in the passageway by an individual locking lance.

According to the present invention, an electrical connector housing for a plurality of electrical contacts is chacterised by first and second housing parts of electrically insulated material and a strip carrying a plurality of locking lances. Each housing part includes cooperating means for latching the first and second housing parts together and each housing part has a row of spaced, parallel passageways. The passageways of the housing parts are aligned to define a row of cavities extending between opposed faces of the connector housing for receiving electrical contacts. The strip is assemblied in the first housing part so that an individual locking lance extends into each cavity defined by the passageways of the first and second housing parts for resiliently engaging an electrical contact when received in the cavity.

Since the locking lances and the strip are manufactured separately of the housing parts, the mould tools required for the housing part are simple in construction. Furthermore, the strip and locking lances are easily assembled to the first housing part and require no special skills on the part of an assembler.

In a preferred embodiment, the strip and the locking lances are moulded as an integral one-piece item. In electrical connector housings where many electrical contacts are received in rows and columns of cavities the provision of locking lances carried by strips each strip being associated with a row, simplifies mould design with consequence economic advantages.

An embodiment of the invention will now be described, by way of example, reference being made to the Figures of the accompanying diagrammatic drawings in which:

FIG. 5 is a cross-section on the line V—V of FIG. 3;

FIG. 7 is a plan view of a strip carrying a plurality of locking lances; and

FIG. 8 is a perspective view of a portion of the strip of FIG. 7.

Figure 1:
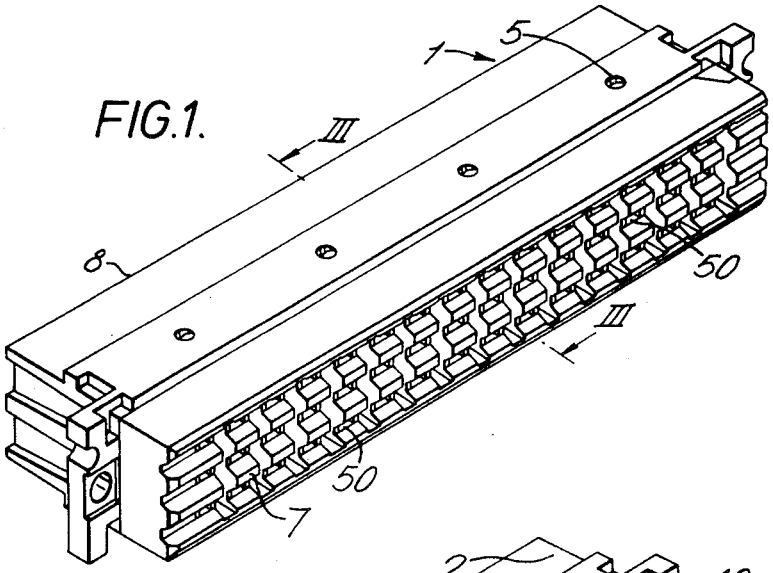
FIG. 1 is a perspective view of an electrical connector housing.
Figure 2:
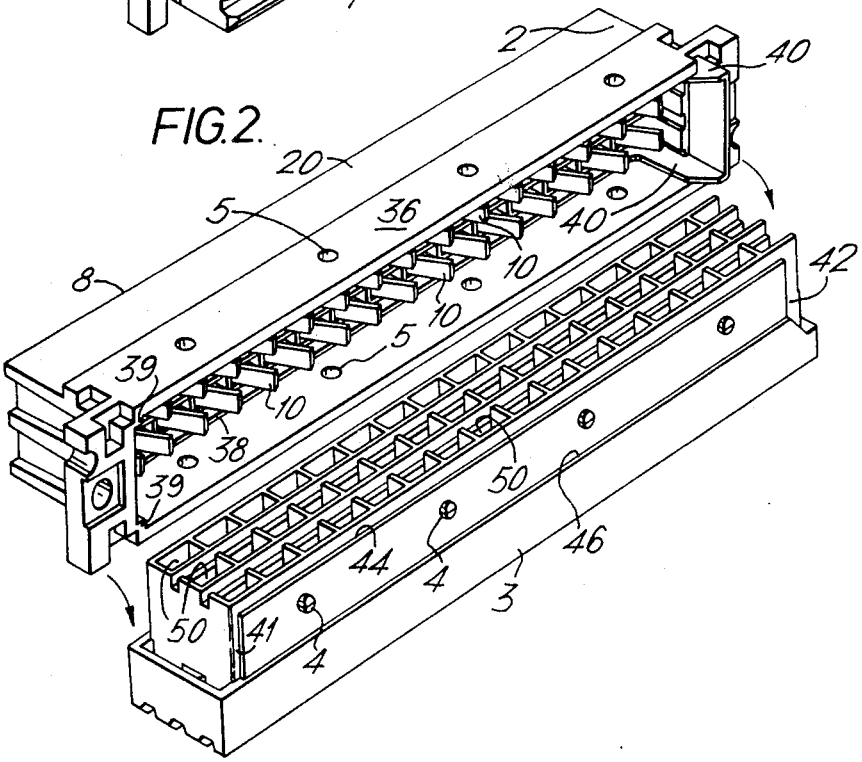
FIG. 2 is a perspective view similar to FIG. 1 but with two housing parts separated to reveal the interior of one housing part.

As shown, an electrical connector housing 1 for a plurality of electrical contacts 13 (only one shown in FIG. 5), comprises first and second housing parts 2, 3 of electrically insulating material and a strip 11 carrying a plurality of locking lances 10.

The first housing part 2 includes a body portion 20 through which pass a plurality of spaced, parallel passageways 22 forwardly from a rear face 8. The passageways 22 are arranged in three rows. Each passageway 22 is separated from adjacent passageways 22 by side walls 24 and adjacent rows are separated by partitions 26. A member 28 extends from each side wall 24 into an associated passageway 22. The member 28 is formed with a forwardly facing recess 30. A forward portion of each side wall 24 is of reduced height and, in effect, the forward portions of each side wall of each row define a channel 32 communicating with each of the passageways 22 of the row.

Contact stablilizing ribs 34 extend along the length of each passageway 22 adjacent a side wall 24.

A hood 36 extends forwardly from the body portion 20 and has upper and lower (as shown) forwardly facing shoulders 38. Polarising ribs 39,40 extend forwardly along each corner of the hood 36, the ribs being profiled and extending outwardly a short distance from the hood 36. The hood has two sets of four through holes 5 along its upper and lower (as shown) sides. The forward face of the hood 36 is open to permit entry of a rear portion of the second housing part 3 as will be explained.

Figure 3:
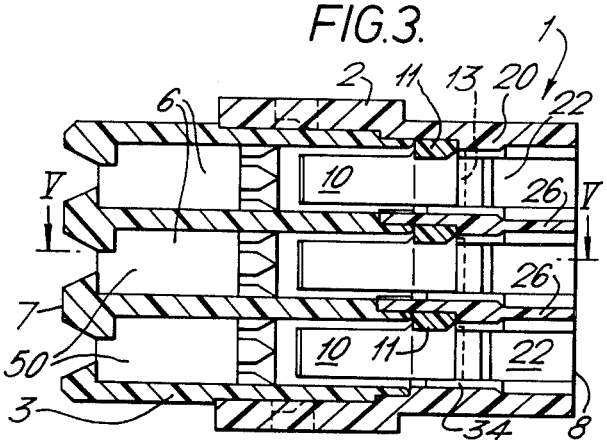
FIG. 3 is a cross-section on the line III—III of FIG. 1.
Figure 4:
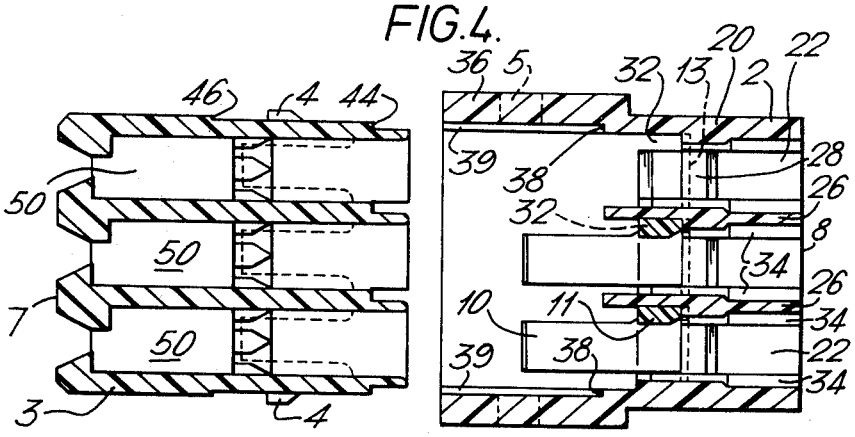
FIG. 4 is a cross-section similar to FIG. 3 but showing the two housing parts separated.
Figure 6:
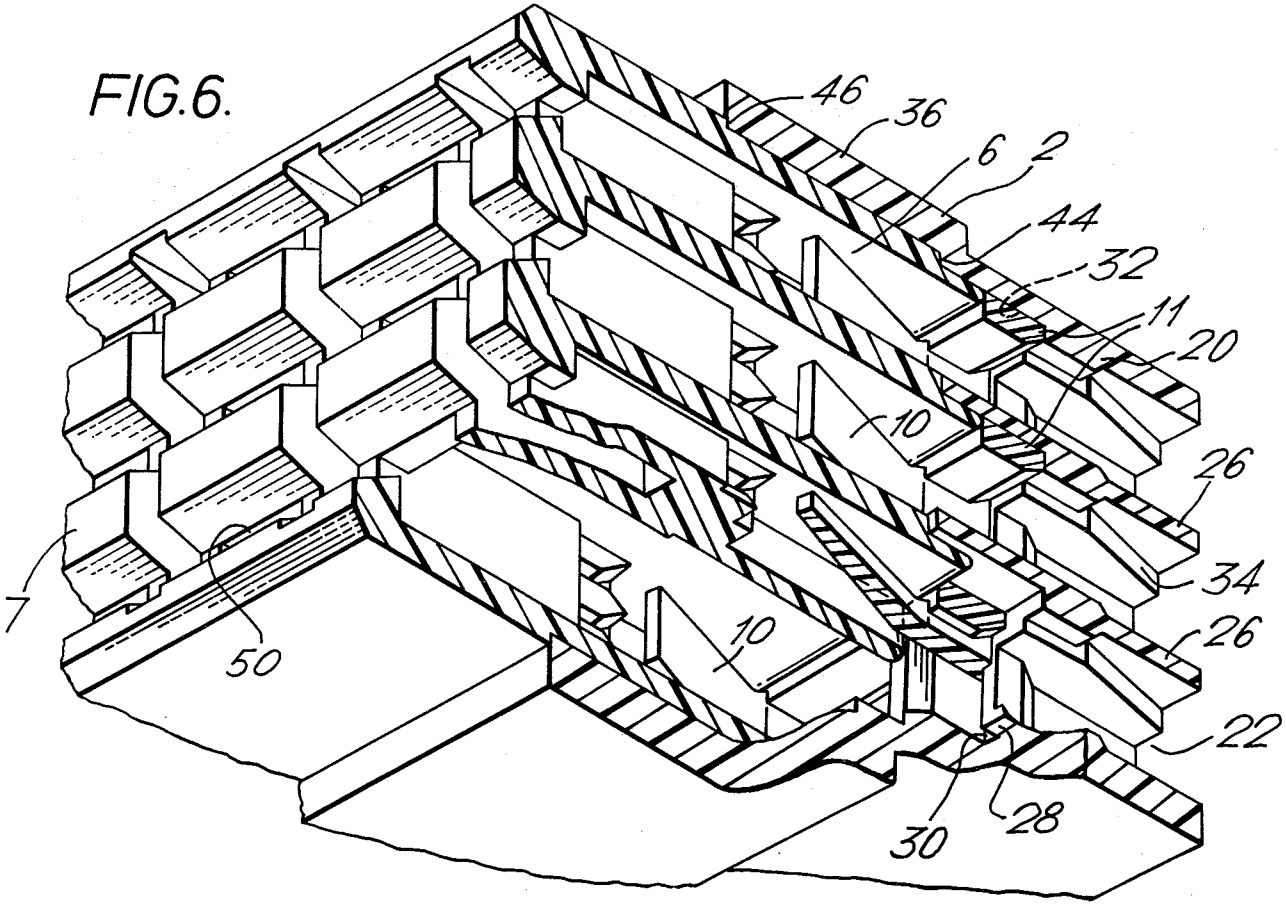
FIG. 6 is a cross-sectional detail of the electrical connector housing of FIG. 1.

The second housing part 3 has a body through which pass a plurality of spaced, parallel passageways 50 rearwardly from a forward surface 7. The upper and lower (as shown in FIGS. 1, 3 and 4) sides of the housing part 3 have polarisingchannels 41,42 which cooperate respecting with the ribs 39,40 on the hood 36 of the housing part 2. The upper and lower sides also have rearwardly facing shoulders 44,46 and detents 4 arranged in two sets of four for cooperation with the holes 5.

The passageways 50 are arranged in three rows and when the housing parts 2,3 are releasably latched together as will be explained, each passageway 50 is aligned with a passageway 22 to define a cavity 6.

Referring in particular to FIGS. 7 and 8, a plurality of equi-spaced, generally parallel, resilient locking lances 10 are carried by an elongate strip 11. The strip 11 and the locking lances 10 are moulded as an integral one-piece item of plastics material. Each locking lance 10 extends from one surface of the substantially flat strip 11 and a major portion of each lance 10 extends laterally outwardly from one side of the strip 11. However, a minor portion 12 of each lance 10 extends laterally outwardly from the opposite side of the strip 11. The minor portion 12 of each lance 10 is stepped to define a protuberance 13.

On assembling the electrical connector housing 1, a strip 11 is inserted into each channel 32 communicating with a row of passageway 22 via the open forward face of the hood 36 so that each protuberance 13 is received in a recess 30. Next, the rear portion of the housing part 3 is inserted into the housing part 2 via the open forward face of the hood 36 and is releasably latched to the housing part 2 by means of the cooperating detents 4 and holes 5 so that an individual locking lance 10 extends into each cavity 6 defined by the aligned passageways 22,50. The cooperating polarising ribs 39,40 and channels 41,42 prevent incorrect assembly of the housing parts 2 and 3 together. When the housing parts 2,3 are correctly assembled, the shoulder 44 on the housing part 3 engages theshoulder 38 of the housing part 2 and the shoulder 46 engages the free end face of the hood 36. It can be seen that the rear end of the housing part 3 prevents the strips 11 from being accidentally moved from their respective channels 32.

Referring especially to FIG. 5, there is shown an electrical contact 13 received in a cavity 6 and maintained in the cavity 6 by a resilient locking lance 10. The contact 13 is positioned in the cavity 6 via the rear face 8 of the electrical connector housing 1.

An advantage of the electrical connector housing described above is that the use of a strip of locking lances which can be easily and rapidly assembled to the housing part 2 eliminates the need for a complicated mould design for the connector housing where each cavity has its own individual locking lance moulded in one-piece with the wall of the cavity.

Although detents 4 and holes 5 have been described for releasably latching the housing parts 2,3 together other cooperating means can be used including means for permanently maintaining the housing parts together.

What is claimed is:

1. An electrical connector housing for a plurality of electrical contacts comprising:

a. first and second housing parts of electrical insulating material and being adapted for mating one with the other, each housing part having at least one row of spaced parallel passageways, the passageways of the housing parts being aligned to define at least one row of cavities extending between opposed faces of the housings when mated for receiving electrical contacts;

b. a channel in the first housing part extending across the passageways;

c. an elongated strip of insulating material having a plurality of spaced apart lances projecting outward form one edge, said strip positioned in the channel with individual lances extending into the cavities in the row for resiliently engaging and retaining electrical contacts which may be inserted into the cavities.

2. An electrical connector housing comprising first and second housing parts of insulating material and a strip carrying a plurality of locking lances extending from one surface of the strip, a major portion of each lance extending laterally outwardly from one side of the strip, but a minor portion of each lance extending laterally outwardly from the opposite side of the strip, the locking lances being generally parallel and equi-spaced along the length of the strip, and each minor portion being stepped to define a protuberance, each housing part including cooperating means for latching the first and second housing parts together, each housing part having a row of spaced, parallel passageways, the passageways of the housing parts being aligned to define a row of cavities extending between opposed faces of the connector housing for receiving electrical contacts, the strip being assembled in the first housing part so that an individual locking lance extends into each cavity defined by the passageways of the first and second housing parts for resiliently engaging an electrical contact when received in the cavity.

3. An electrical connector housing as claimed in claim 2, in which the strip is received in a channel in the first housing part, the channel communicating with each passageway of the row of passageways in the first housing part, the protuberance on each locking lance being received in a recess in the respective pasageway of the first housing part to locate the locking lance in the cavity.

4. An electrical connector housing as claimed in claim 3, in which the first housing part has a body portion through which the spaced, parallel passageways pass forwardly from a rear surface and a hood extending forwardly from the body portion, the hood receiving a rear portion of the second housing, the hood and the rear portion having co-operating detents and holes for latching releasably the housing parts together.

* * * * *